US008347542B2

(12) United States Patent
Rich

(10) Patent No.: US 8,347,542 B2
(45) Date of Patent: Jan. 8, 2013

(54) FIREARM COVER

(76) Inventor: Kevin Wayne Rich, Middleton, ID (US)

( * ) Notice: Subject to any disclaimer, the term of this patent is extended or adjusted under 35 U.S.C. 154(b) by 0 days.

(21) Appl. No.: 13/009,772

(22) Filed: Jan. 19, 2011

(65) Prior Publication Data

US 2012/0042554 A1 Feb. 23, 2012

Related U.S. Application Data

(60) Provisional application No. 61/296,360, filed on Jan. 19, 2010.

(51) Int. Cl.
*F41A 35/02* (2006.01)

(52) U.S. Cl. ..... 42/96

(58) Field of Classification Search ..... 42/96, 90, 42/83, 85

See application file for complete search history.

(56) References Cited

U.S. PATENT DOCUMENTS

| | | | | |
|---|---|---|---|---|
| 4,949,929 | A * | 8/1990 | Kesselman et al. | 248/300 |
| 5,768,819 | A * | 6/1998 | Neal | 42/96 |
| 6,604,311 | B1 * | 8/2003 | Laney et al. | 42/51 |
| 6,761,101 | B1 * | 7/2004 | Luth | 89/37.04 |

* cited by examiner

*Primary Examiner* — Michael Carone
*Assistant Examiner* — John D Cooper
(74) *Attorney, Agent, or Firm* — Parsons Behle & Latimer

(57) ABSTRACT

A cover for a firearm is disclosed. The firearm cover is shaped to complement the bottom of an upper portion of a two piece receiver. The firearm cover may be pinned to the bottom of an AR-15® upper receiver and may cover a bottom opening and/or a rear opening when in place. When secured in place, the firearm cover may capture a bolt carrier within an inner cavity of the upper receiver. Additionally, the firearm cover will protect the inner cavity, keeping dust, debris, and moisture out of the upper receiver.

11 Claims, 5 Drawing Sheets

FIREARM COVER

RELATED APPLICATIONS

The present disclosure claims benefit of U.S. Provisional Patent Application No. 61/296,360 entitled "Firearm Cover", filed on Jan. 19, 2010 by Kevin W. Rich, the disclosure of which is hereby incorporated by reference in its entirety.

BACKGROUND

1. Field of the Invention

The present application relates generally to a cover for a firearm. More specifically, the present application relates to protecting the upper receiver and/or the bolt of a firearm that comprises a multi-portion receiver, such as an AR-15®.

2. Description of the Related Art

Assault weapons and/or assault rifles generally have, among other things, a bolt carrier and a receiver comprising a plurality of portions. For example, an AR-15® has a receiver comprising two pieces; an upper receiver portion and a lower receiver portion. A bolt carrier is typically positioned inside the upper receiver portion and is captured within the upper receiver portion by the lower receiver portion.

The upper receiver portion is typically selectively fastened to the lower receiver portion, such as by a number of pins, and may be disconnected from the lower receiver portion, such as for transport and/or storage. Additionally, the upper receiver portion may be disconnected from a lower receiver portion so that it may be used with a plurality of different lower receiver portions.

When the upper receiver portion is disconnected from the lower receiver portion, the bolt is at liberty to move within the upper receiver portion and may fall out of the upper receiver portion. Additionally, when the upper receiver portion is disconnected from the lower receiver portion, dirt, debris, and/or moisture may be introduced within the upper receiver portion, which may require that the upper receiver portion be cleaned or repaired before further use within a firearm.

The present disclosure is directed to overcoming, or at least reducing the effects, of one or more of the issues set forth above.

SUMMARY

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment is a firearm cover having a body that includes a front portion and a rear portion. The rear portion of the cover is connected to a shield portion that is configured to substantially cover a rear opening in an upper receiver portion of a firearm. A portion of the body is configured to substantially cover a bottom opening in the upper receiver portion of the firearm. The firearm cover includes at least one connecting mechanism that is configured to secure the firearm cover to the upper receiver portion of the firearm.

The at least one connecting mechanism may be at least one pin. The cover may include a front connecting mechanism and a rear connecting mechanism, which both may be pins. The firearm cover may be configured to prevent communication between the bottom opening of the upper receiver portion and an object. The firearm cover may be configured to prevent insertion of an object through the bottom opening of the upper receiver portion when the firearm cover is installed onto the upper receiver portion. The firearm cover may be fabricated as a single piece or alternatively may be comprised of multiple pieces connected together.

One embodiment is a firearm receiver assembly including an upper receiver portion of a firearm, a bolt carrier, and a firearm cover. The upper receiver portion is configured to connect to a lower receiver portion and includes an inner cavity, a rear opening, and a bottom opening. The rear opening and bottom opening both provide access to the inner cavity of the upper receiver portion. The bolt carrier is positioned within the inner cavity of the upper receiver portion. The firearm cover is secured to the upper receiver portion and substantially covers at least the rear opening and the bottom opening. The firearm may be a rifle or an assault rifle. The firearm may be an AR-15®.

One embodiment is a method of using a firearm cover. The method includes positioning a firearm cover over the bottom of an upper receiver portion and covering an opening in the bottom of the upper receiver portion. The top of the firearm cover has a shape that complements the shape of the bottom of the upper receiver portion. The method includes covering an opening in the rear of the upper receiver portion with a shield portion of the firearm cover. The shield portion may be attached to the firearm cover or may be integral to the firearm cover. The shield portion has a shape that complements the shape of the rear of the upper receiver portion. The method includes inserting a front pin through a front pin guide in the firearm cover and through an opening in a front connector mechanism of the upper receiver portion and inserting a rear pin through a rear pin guide in the firearm cover and through an opening in a rear connector mechanism of the upper receiver portion. The method may include turning the upper receiver portion on a side or its top prior to position the firearm cover over the bottom of the upper receiver portion.

These and other embodiments of the present application will be discussed more fully in the detailed description. The features, functions, and advantages can be achieved independently in various embodiments of the claimed invention, or may be combined in yet other embodiments.

Figure 1:
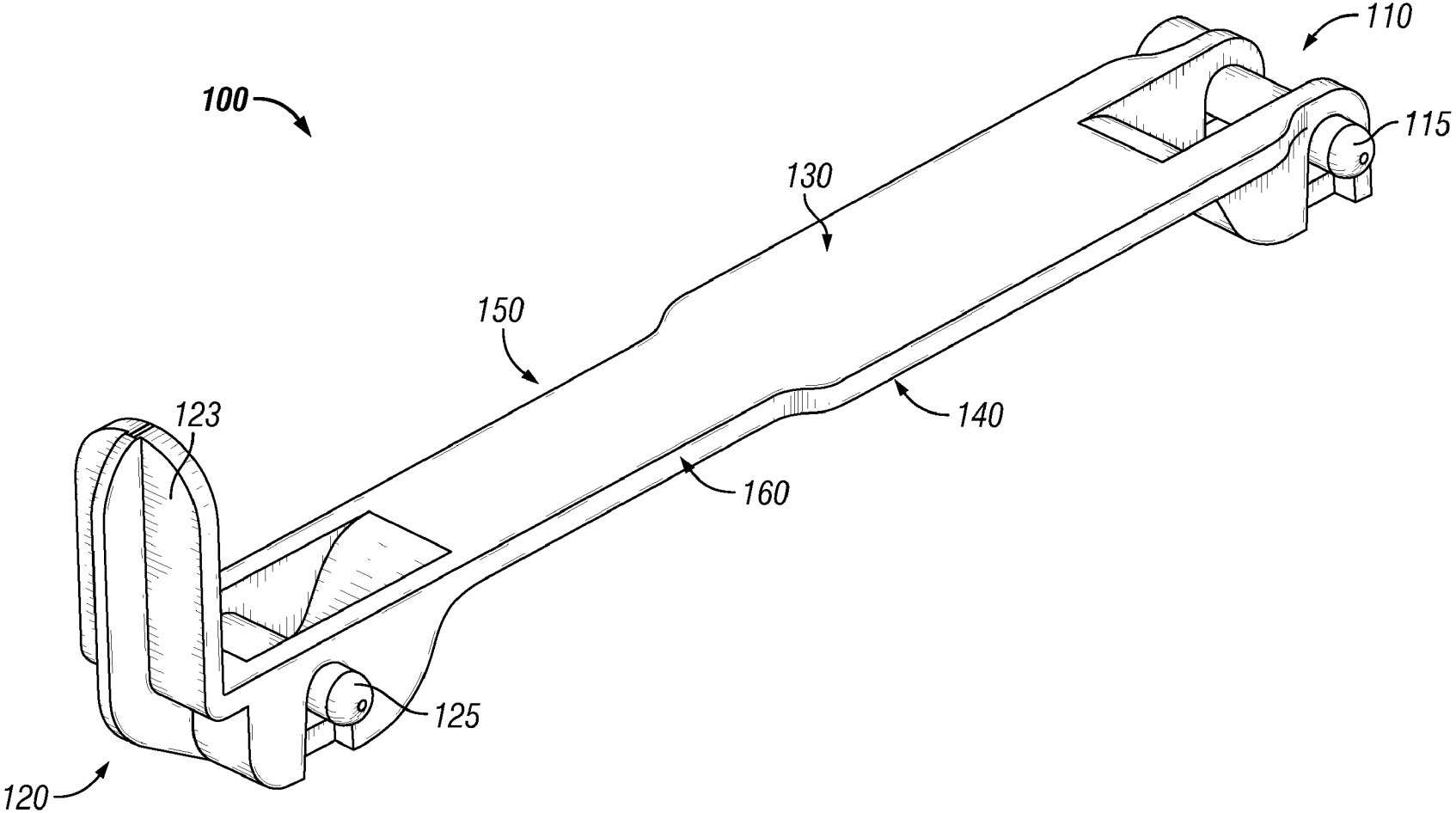
FIG. 1 is a perspective view of an embodiment of a firearm cover.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope as defined by the appended claims.

DETAILED DESCRIPTION

Illustrative embodiments are described below as they might be employed in a firearm cover as it may be used with a firearm. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

FIG. 1 illustrates an embodiment of a firearm cover 100. The firearm cover 100 comprises a front 110, rear 120, top 130, bottom 140, left side 150, and right side 160. FIG. 1 shows a perspective view of the rear 120, top 130, and right 160 sides of the firearm cover 100. The firearm cover 100 further comprises a shield portion 123 positioned at the rear end 120. Additionally, a front pin 115 and a rear pin 125 are shown in FIG. 1. The pins 115, 125 are inserted through a front pin guide 117 and a rear pin guide 127 (best shown in FIG. 4), respectively. The pins may be ¼ inch diameter pins, or may be another suitable size.

As shown in FIG. 1, the firearm cover 100 may be fabricated as a single piece. For example, the firearm cover 100 may be fabricated in a single piece with an injection molding manufacturing process. Alternatively, the firearm cover 100 may be manufactured as a plurality of portions that are connected to form the firearm cover 100. The firearm cover 100 may comprise one or more materials, such as one or more types of plastic, metal, composite, or other suitable material, as would be apparent to one of ordinary skill in the art, given the benefit of this disclosure.

Figure 2A:
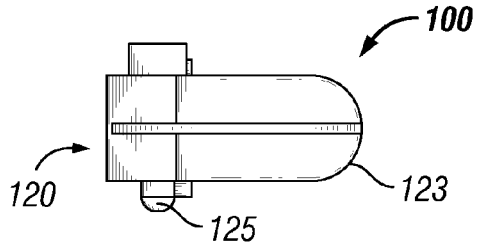
FIG. 2A is a rear view of the embodiment of the firearm cover of FIG. 1.
Figure 2B:
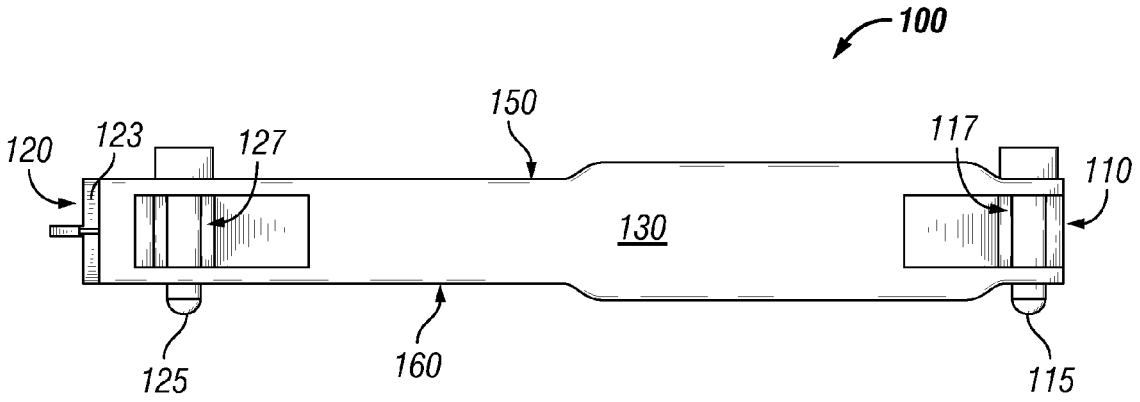
FIG. 2B is a top view of the embodiment of the firearm cover of FIG. 1.
Figure 2C:
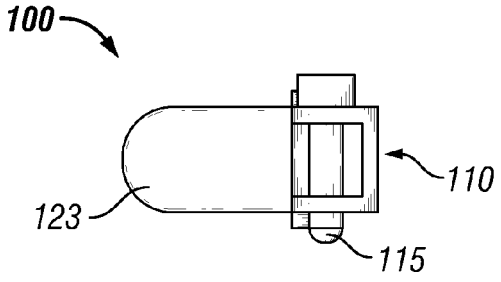
FIG. 2C is a front view of the embodiment of the firearm cover of FIG. 1.
Figure 2D:
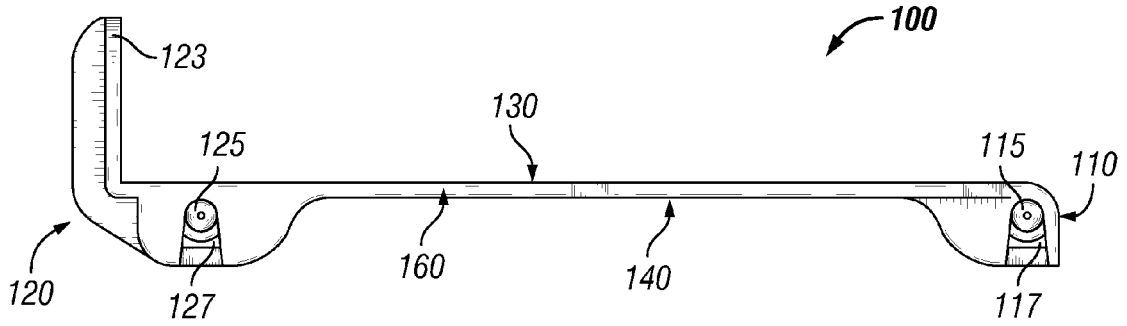
FIG. 2D is a right side view of the embodiment of the firearm cover of FIG. 1.
Figure 2E:
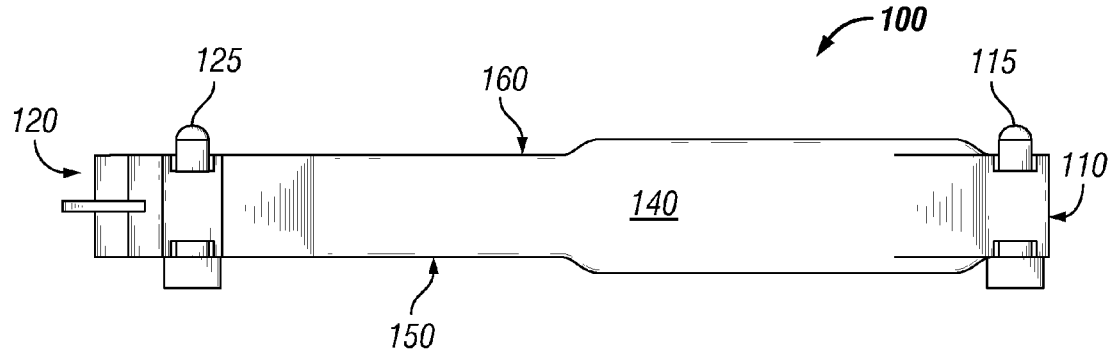
FIG. 2E is a bottom view of the embodiment of the firearm cover of FIG. 1.
Figure 2F:
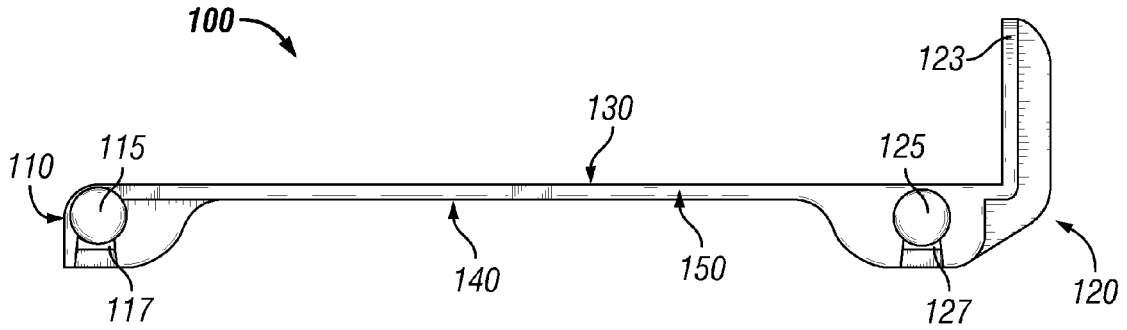
FIG. 2F is a left side view of the embodiment of the firearm cover of FIG. 1.

FIGS. 2A through 2F each show different views of the firearm cover 100 of FIG. 1. FIG. 2A is a rear view of the firearm cover 100 and shows the rear 120, the rear of the shield portion 123, and rear pin 125. FIG. 2B is a top view of the firearm cover 100, showing the top 130, portions of the front 110 and the rear 120, and the top side of the shield portion 123. The front pin 115 is inserted through the front pin guide 117 and the rear pin 125 is inserted through the rear pin guide 127. FIG. 2C is a front view of the firearm cover 100 and shows the front 110 and the front side of the shield portion 123. The front pin 115 is inserted through the front pin guide 117. FIG. 2D shows the firearm cover 100 from the right. The right side of the front 110, the rear 120, and the shield portion 123 are also shown. The front and rear pins 115, 125 are inserted through the front and rear pin guides 117, 127. FIG. 2E shows the firearm cover from the top 140. The front and rear pins 115, 125 are inserted through the front and rear pin guides 117, 127. FIG. 2F shows the firearm cover 100 from the left. The left side of the front 110, the rear 120, and the shield portion 123 are also shown. The front and rear pins 115, 125 are inserted through the front and rear pin guides 117, 127.

Figure 3:
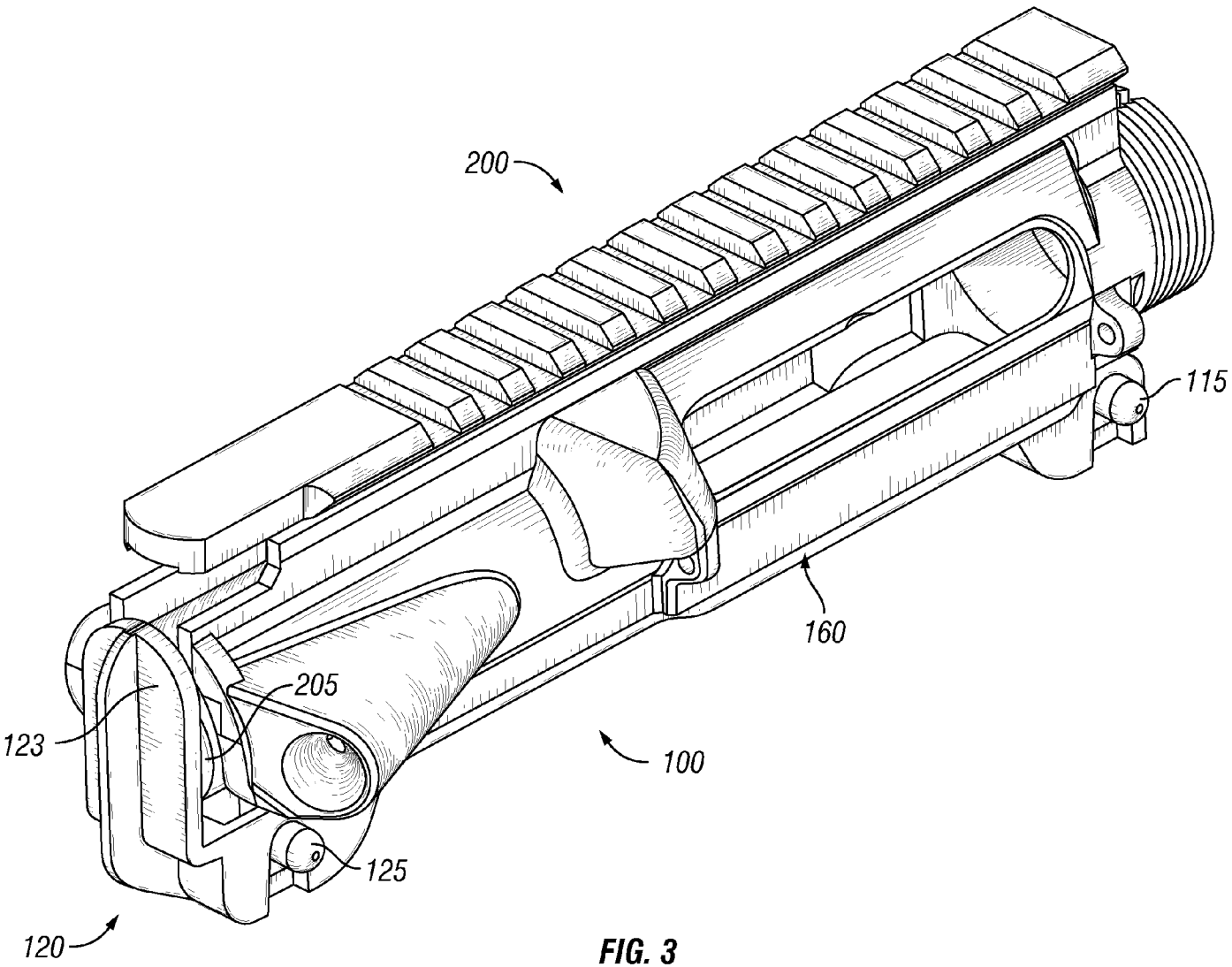
FIG. 3 is a perspective view of the embodiment of the firearm cover of FIG. 1 as it may be installed on a portion of a firearm.

FIG. 3 shows a perspective view of the firearm cover 100 as it may be used with a portion of a firearm, such as an upper receiver 200. As shown in FIG. 3, the firearm cover 100 has been positioned over the bottom of the upper receiver 200 and has been secured to the upper receiver 200 with the front and rear pins 115, 125. The firearm cover 100 may be used with a portion of an AR-15® or an M-16, or may be used with a portion of another suitable assault weapon or assault rifle.

Figure 4:
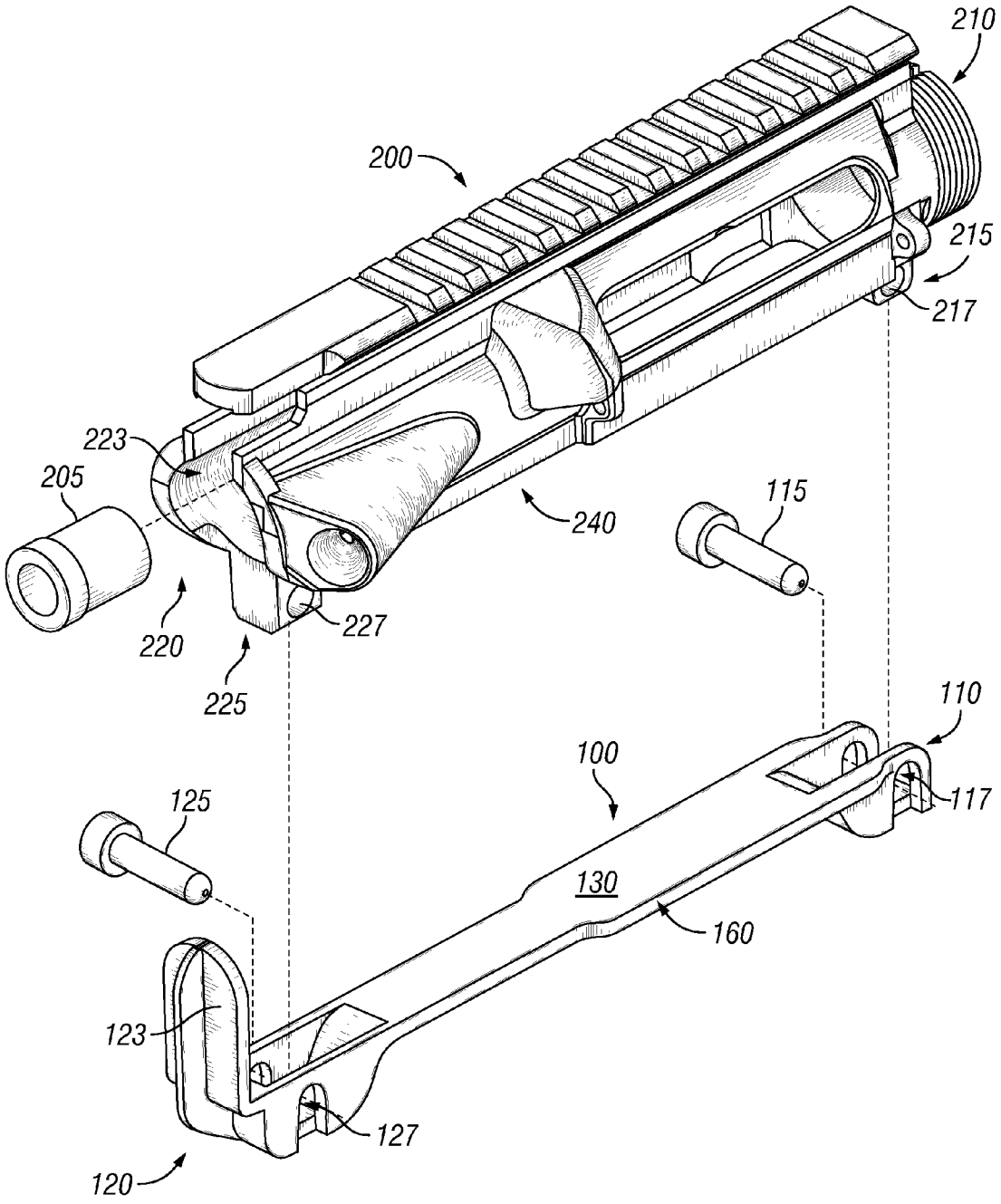
FIG. 4 is an exploded perspective view of the embodiment of the firearm cover of FIG. 1 as it may be installed on a portion of a firearm.

FIG. 4 is an exploded view of the firearm cover 100 and the upper receiver 200 assembly of FIG. 3. As shown in FIG. 4, the upper receiver 200 comprises a front end 210, a rear end 220, a bottom 240, and a plurality of connectors, including a front connector 215 with a front pin opening 217 and a rear connector 225 with a rear pin opening 227. The front and rear connectors 215, 225 are located on the bottom side of the upper receiver 200. The front and rear connectors 215, 225 may be used to connect the upper receiver 200 to another portion of a firearm, such as to one of a plurality of lower receivers (not shown).

Also shown in FIG. 4 is a carrier bolt portion ("bolt") 205 that is typically positioned within an inner cavity of the upper receiver 200. The bolt 205 may be selectively positioned within the inner cavity of the upper receiver 200 through an opening in the upper receiver 200, such as a rear opening 223 or a bottom opening (not shown).

As can be seen in FIG. 4, the firearm cover 100 is generally L-shaped, having a long planar portion with a shorter, generally planar shield portion 123 that is connected to the rear 120. The firearm cover 100 is generally shaped to conform to the bottom 240 and rear 220 of the upper receiver 200. In other embodiments, the firearm cover 100 may be shaped to conform to the bottom of another type of upper receiver 200. Additionally, the firearm cover 100 may be formed to cover additional features of the upper receiver 200. For example, the firearm cover may extend to cover the front 210 of the upper receiver 200.

The firearm cover 100 shown in FIG. 4 may be positioned over the bottom 240 and rear 220 of the upper receiver 200 and may substantially cover the bottom opening and the rear opening 223. Covering the bottom opening and the rear opening 223 may capture the bolt 205 within inner cavity of the upper receiver 200, which may prevent inadvertent expulsion of the bolt 205 from the inner cavity of the upper receiver 200. The upper receiver 200 may be turned on a side or on its top prior to positioning the firearm cover 100 over the bottom 240 and rear 220 to prevent the bolt from falling out of the upper receiver 200.

Front and rear pins 115, 125 may secure the firearm cover 100 to the upper receiver 200, as shown in FIG. 3. The firearm cover 100 may first be positioned over the bottom 240 and the rear 220 of the upper receiver 200. Subsequently, the front pin 115 may be inserted through the front pin guide 117 and the front pin opening 217, and the rear pin 125 may be inserted through the rear pin guide 127 and the rear pin opening 227. Other securing mechanisms or fasteners, such as bolts or cotter pins may be used to secure the firearm cover 100 to the upper receiver 200, as would be apparent to one of ordinary skill in the art, given the benefit of this disclosure.

As mentioned previously, the firearm cover 100 may capture the bolt 205 within the inner cavity of the upper receiver 200 when secured to the upper receiver 200 with the pins 115,

125. Additionally, the firearm cover 100 may prevent dirt, debris, and/or moisture from entering the openings that are covered by the firearm cover 100.

Although this invention has been described in terms of certain preferred embodiments, other embodiments that are apparent to those of ordinary skill in the art, including embodiments that do not provide all of the features and advantages set forth herein, are also within the scope of this invention. Therefore, the scope of the present invention is defined only by reference to the appended claims and equivalents thereof.

What is claimed is:

1. A firearm cover comprising:

a body including a front portion, a rear portion, the rear portion being connected to a shield portion that is configured to substantially externally cover a rear opening in an upper receiver portion of a firearm, a portion of the body being configured to substantially cover a bottom opening in the upper receiver portion; and at least one connecting mechanism comprising at least one pin to secure the firearm cover to the upper receiver portion of the firearm via a pin opening in the upper receiver portion of a firearm.

2. The assembly of claim 1, further comprising a second connecting mechanism.

3. The assembly of claim 2, wherein the second connecting mechanism comprises a second pin to secure the firearm cover to the upper receiver portion of the firearm via a rear pin opening in the upper receiver portion of the firearm.

4. The assembly of claim 1, wherein the firearm cover is configured to prevent communication between the bottom opening of the upper receiver portion and an object.

5. The assembly of claim 1, wherein the firearm cover is configured to prevent insertion of an object through the bottom opening of the upper receiver portion.

6. The assembly of claim 1 wherein the shield portion is adapted to retain a bolt carrier positioned in an inner cavity of the upper receiver portion.

7. The assembly of claim 1 wherein the shield portion is configured to completely cover the rear opening, and the portion of the body is configured to completely cover the bottom opening.

8. A firearm cover comprising:

a body including a front portion, a rear portion, the rear portion being connected to a shield portion that is configured to substantially externally cover a rear opening in an upper receiver portion of a firearm, a portion of the body being configured to substantially cover a bottom opening in the upper receiver portion; and at least one connecting mechanism configured to secure the firearm cover to the upper receiver portion of the firearm; and wherein the firearm cover comprises a single unitary piece when secured to the upper receiver portion of the firearm.

9. A firearm cover comprising:

a first portion configured to externally cover a bottom opening of a receiver portion of a firearm;

a second portion connected to the first portion and configured to externally cover a rear opening of the receiver portion of the firearm; and at least one pin guide connected to at least one of the first and second portions of the firearm cover, and wherein the firearm cover is securable to a receiver portion of a firearm by coupling the at least one pin guide to at least one pin opening in the receiver portion of a firearm with at least one pin.

10. The firearm cover of claim 9 wherein the second portion is adapted to retain a bolt carrier positioned in an inner cavity of the receiver portion of the firearm.

11. The firearm cover of claim 9 wherein the first portion is configured to completely cover the bottom opening, and the second portion is configured to completely cover the rear opening.

* * * * *